US010010992B2

(12) United States Patent
Xue et al.

(10) Patent No.: US 10,010,992 B2
(45) Date of Patent: Jul. 3, 2018

(54) WHEEL DEBURRING DEVICE

(71) Applicant: CITIC Dicastal CO., LTD, Qinhuangdao (CN)

(72) Inventors: Bowen Xue, Qinhuangdao (CN); Yacong Zhang, Qinhuangdao (CN)

(73) Assignee: CITIC Dicastal CO., LTD, Qinhuangdao (CN)

( * ) Notice: Subject to any disclaimer, the term of this patent is extended or adjusted under 35 U.S.C. 154(b) by 124 days.

(21) Appl. No.: 15/152,756

(22) Filed: May 12, 2016

(65) Prior Publication Data

US 2016/0354891 A1 Dec. 8, 2016

(30) Foreign Application Priority Data

Jun. 3, 2015 (CN) ..... 2015 1 0298203

(51) Int. Cl.

| | |
|---|---|
| ***B24B 5/44*** | (2006.01) |
| ***B24B 33/02*** | (2006.01) |
| ***B24B 5/40*** | (2006.01) |
| ***B24B 5/08*** | (2006.01) |
| ***B24B 27/00*** | (2006.01) |
| *B24B 29/00* | (2006.01) |

(52) U.S. Cl.

CPC ..... *B24B 5/44* (2013.01); *B24B 5/08* (2013.01); *B24B 5/40* (2013.01); *B24B 27/0076* (2013.01); *B24B 33/02* (2013.01); *B24B 29/005* (2013.01)

(58) Field of Classification Search

CPC .. B24B 5/06; B24B 5/065; B24B 5/08; B24B 5/14; B24B 5/16; B24B 5/165; B24B 5/40; B24B 5/44; B24B 9/00; B24B 9/04; B24B 27/0076; B24B 29/005; B24B 33/02; B24B 33/025; B24B 39/023

See application file for complete search history.

(56) References Cited

U.S. PATENT DOCUMENTS

| | | | | |
|---|---|---|---|---|
| 4,527,300 | A * | 7/1985 | Kunde | B24B 29/04 15/88.2 |
| 5,161,281 | A * | 11/1992 | Hanen | B08B 1/04 15/88.3 |
| 6,261,160 | B1 * | 7/2001 | Hakomori | B23Q 7/04 451/209 |
| 6,722,961 | B2 * | 4/2004 | Solanellas | B23Q 1/54 451/140 |
| 9,724,796 | B2 * | 8/2017 | Xue | B24B 9/04 |
| 9,782,866 | B1 * | 10/2017 | Xue | B24B 9/04 |

* cited by examiner

*Primary Examiner* — Timothy V Eley
(74) *Attorney, Agent, or Firm* — Maier & Maier, PLLC

(57) ABSTRACT

The present invention discloses a wheel deburring device, including a rack, gears, gear racks, servo motors, cylinders and hair brushes and the like. In the use of the wheel deburring device, one servo motor can be used for achieving simultaneous rotation of left and right hair brushes and also adjusting the distance between the left and right hair brushes, and a clamping system can automatically adjust the position of radial blocks to make the distance between the left hair brush and the right hair brush adapt to wheels with different sizes; meanwhile, the wheel deburring device has the advantages of high degree of automation, advanced process, strong universality and safe and stable performance.

3 Claims, 5 Drawing Sheets

WHEEL DEBURRING DEVICE

TECHNICAL FIELD

The present invention relates to a deburring device, in particular to a wheel back cavity deburring device.

BACKGROUND ART

In a production process of aluminum alloy wheels, removing back cavity burrs is a very important procedure, which directly influences the subsequent coating yield. A traditional burr brushing machine can only brush a wheel type with one size via one apparatus, and the size of the wheel type is very inconvenient to change, so that the efficiency is very low. In addition, the traditional burr brushing manner is to directly brush burrs on a wheel back cavity by a large disc hair brush under the action of pressure, and in this manner, when an angular speed is constant, the difference of linear speeds between the outer ring and the inner ring of the hair brush is very large, resulting in an unsatisfactory burr brushing effect. Based on the above two points, a burr brushing apparatus, being universal to all sizes and having an ideal burr brushing effect, has been always researched in the wheel industry.

SUMMARY OF THE INVENTION

The purpose of the present invention is to provide a wheel deburring device. When the wheel deburring device is in use, one servo motor can be used for both achieving simultaneous rotation of left and right hair brushes and adjusting the distance between the left and right hair brushes, and a clamping system can automatically adjust the positions of radial blocks.

To fulfill the aforementioned purpose, the technical solution of the present invention is as follows: the wheel deburring device consists of a frame, guide posts, a cylinder I, a motor, a rotary joint, a lower belt pulley I, a lower belt pulley II, a lower belt pulley III, sliding sleeves, a servo motor I, a lifting plate, a large bearing seat, a hollow shaft, a spline sleeve, a spline shaft, upper belt pulleys I, bearing seats I, shafts I, gears I, upper belt pulleys II, gear racks I, radial blocks, a left bottom plate, a left shaft, a left bearing seat, the left hair brush, a substrate, an upper rotating ring, gears II, a lower rotating ring, an upper belt pulley III, a right hair brush, a right shaft, a right bearing seat, a right bottom plate, a clamping synchronous belt, a cylinder II, a tensioning wheel, a framework, a tensioning cylinder, a lower belt pulley IV, a servo motor II, a left gear rack, a left guide rail, a guide rail I, a right gear rack, a right guide rail, a guide rail II, a guide rail III, an upright plate and a transmission synchronous belt. Both of the cylinder II and the cylinder I are fixed on the bottom plate of the frame; the output end of the cylinder II is hinged to the lower side of the lifting plate; four guide posts are fixed between the bottom plate and a working platform of the frame; the rotary joint is fixed between the cylinder I and the spline shaft; four sliding sleeves matched with the guide posts are fixed on the lifting plate; the motor with the lower belt pulley III mounted at the output end is mounted below the lifting plate by a flange; the large bearing seat is fixed above the lifting plate; the hollow shaft is fixed in the large bearing seat by a bearing, the upper side of the hollow shaft is connected with the substrate, and the lower belt pulley II is fixed at the lower end of the hollow shaft; the spline sleeve with the lower belt pulley I fixed at the lower end is fixed in the hollow shaft by a bearing, and the spline shaft is matched with the spline sleeve; the upper belt pulley III is fixed below the substrate by the lower rotating ring; the gear II is fixed above the substrate by the upper rotating ring.

The left bearing seat is fixed above the left bottom plate, and the left shaft with the left hair brush fixed at the upper side and the upper belt pulleys II fixed at the lower side is fixed in the left bearing seat by a bearing. The right bearing seat is fixed above the right bottom plate, and also the right shaft with the right hair brush fixed at the upper side and the upper belt pulleys II fixed at the lower side is fixed in the right bearing seat by a bearing.

Both one end of the left gear rack and one end of the slide rail of the guide rail II are fixed below the left bottom plate; the left gear rack is fixed on the slide rail of the left guide rail; both one end of the slide rail of the guide rail I and one end of the right gear rack are fixed below the right bottom plate; the right gear rack is fixed on the slide rail of the right guide rail; the left gear rack and the right gear rack are simultaneously engaged with the gears II; the slide blocks of the left guide rail, guide rail I, right guide rail and guide rail II are all fixed above the substrate; the tensioning wheel is fixed in the framework, the tensioning cylinder is fixed at the upper end of the hollow shaft, and the output end of the tensioning cylinder is connected with the framework; the servo motor II with the lower belt pulley IV mounted at the output end is fixed below the lifting plate by a flange; the transmission synchronous belt is simultaneously engaged with two upper belt pulleys II, the upper belt pulley III and the tensioning wheel; and the above components form a burr brushing system of the device.

Four bearing seats I are uniformly distributed and fixed on corresponding positions below the working platform of the frame; four shafts I with the gears fixed at the upper ends and the upper belt pulleys I fixed at the lower ends are fixed in the bearing seats I by bearings; the servo motor I is fixed on the side face of the frame, and the output end of the servo motor I is connected with one shaft I therein; the clamping synchronous belt is simultaneously connected with four upper belt pulleys I; four radial blocks are respectively fixed at each end of four gear racks I; one side of the gear rack I is engaged with the gear I, the other side of the gear rack I is fixed on the slide rail of the guide rail III, and the slide block of the guide rail III is fixed on the upright plate; and the above components form a clamping system of the device.

One servo motor II can be used for both achieving simultaneous rotation of the left hair brush and the right hair brush and adjusting the distance between the left hair brush and the right hair brush by the mutual engagement of the left gear rack, the right gear rack and the gear II to make the distance between the left hair brush and the right hair brush adapt to wheels with different sizes. The servo motor I simultaneously drives four gears I to rotate by the upper belt pulleys I and the clamping synchronous belt, and wheels with different sizes can be automatically clamped by the four gear racks I.

In actual use, according to the size of the wheel, the servo motor I drives the clamping synchronous belt to simultaneously drive the four gears I to rotate, and the wheel can be automatically clamped by the four gear racks I and the radial blocks; the cylinder I jacks up the spline shaft to make lug rings at the top end thereof match with the gear II, the servo motor II drives the spline shaft and the gear II to rotate by the lower belt pulley IV, and then automatically adjusts the distance between the left hair brush and the right hair brush by the left gear rack and the right gear rack according to the size of the wheel; then, the cylinder I lowers the spline shaft to make the lug rings at the top end thereof match with the upper belt pulleys III, and the servo motor II drives the spline shaft, the upper belt pulley III, two upper belt pulleys II, the left hair brush and the right hair brush to simultaneously rotate by the lower belt pulley IV; meanwhile, the motor drives the hollow shaft, the substrate and the two hair brushes to simultaneously rotate around the central axis of the wheel by the lower belt pulley III; and the cylinder II jacks up the left and right hair brushes by the guide posts to make the left and right hair brushes touch the wheel back cavity, and then deburring can be carried out.

When the invention is in use, one servo motor can be used for both achieving simultaneous rotation of the left and right hair brushes and adjusting the distance between the left and right hair brushes, and the clamping system can automatically adjust the positions of radial blocks to make the same adapt to wheels with different sizes; and meanwhile, it has the characteristics of high degree of automation, advanced process, strong universality and safe and stable performance.

Figure 1:
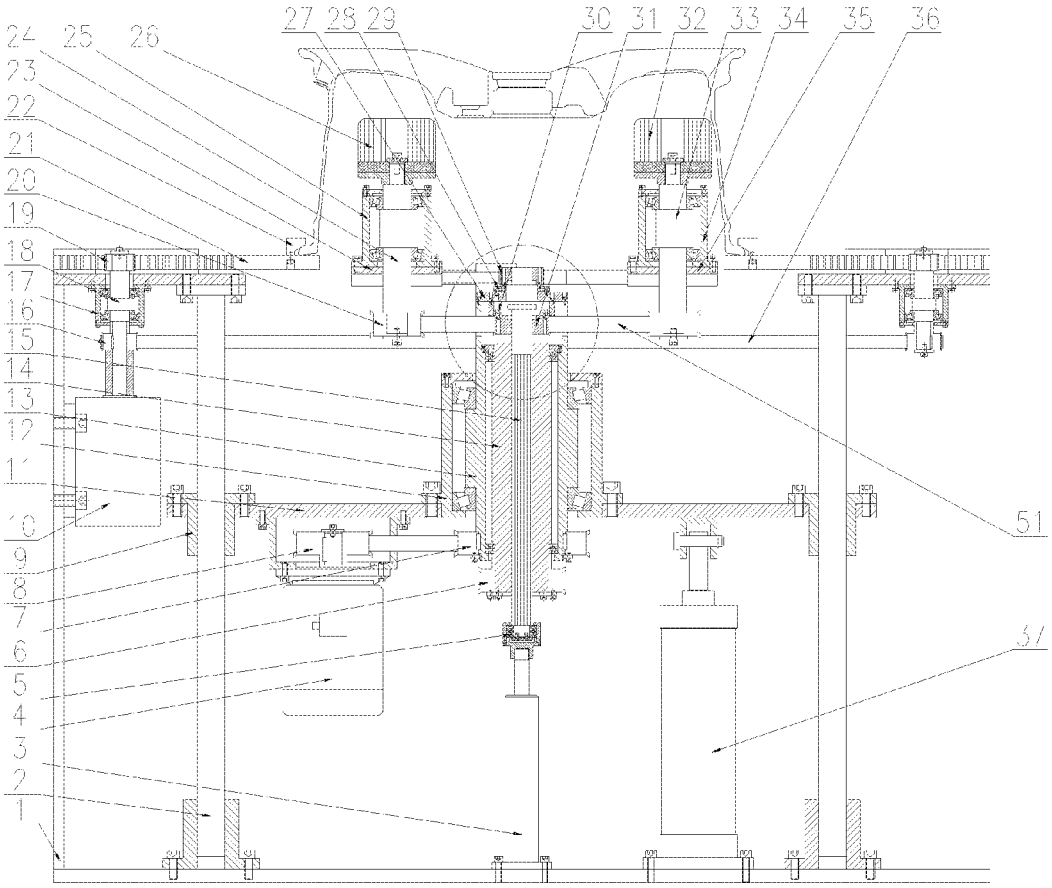
FIG. 1 is a front view of a wheel deburring device in the present invention.
Figure 2:
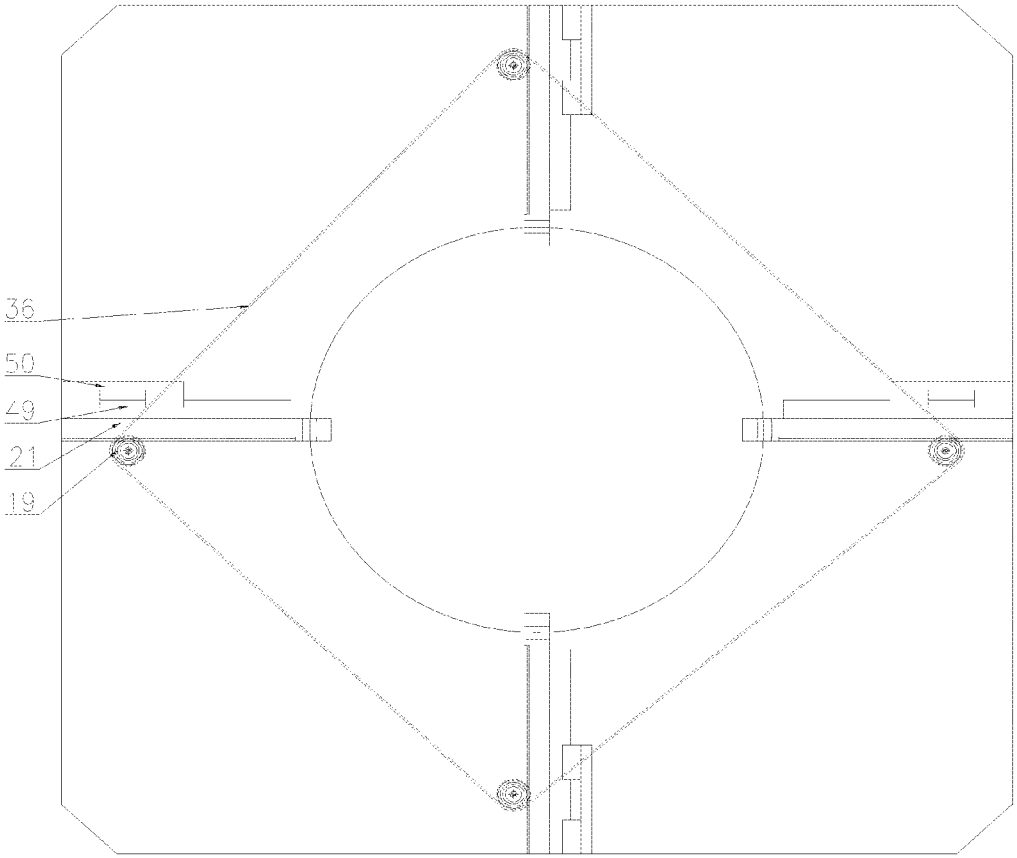
FIG. 2 is a top view of a wheel deburring device in the present invention.
Figure 3:
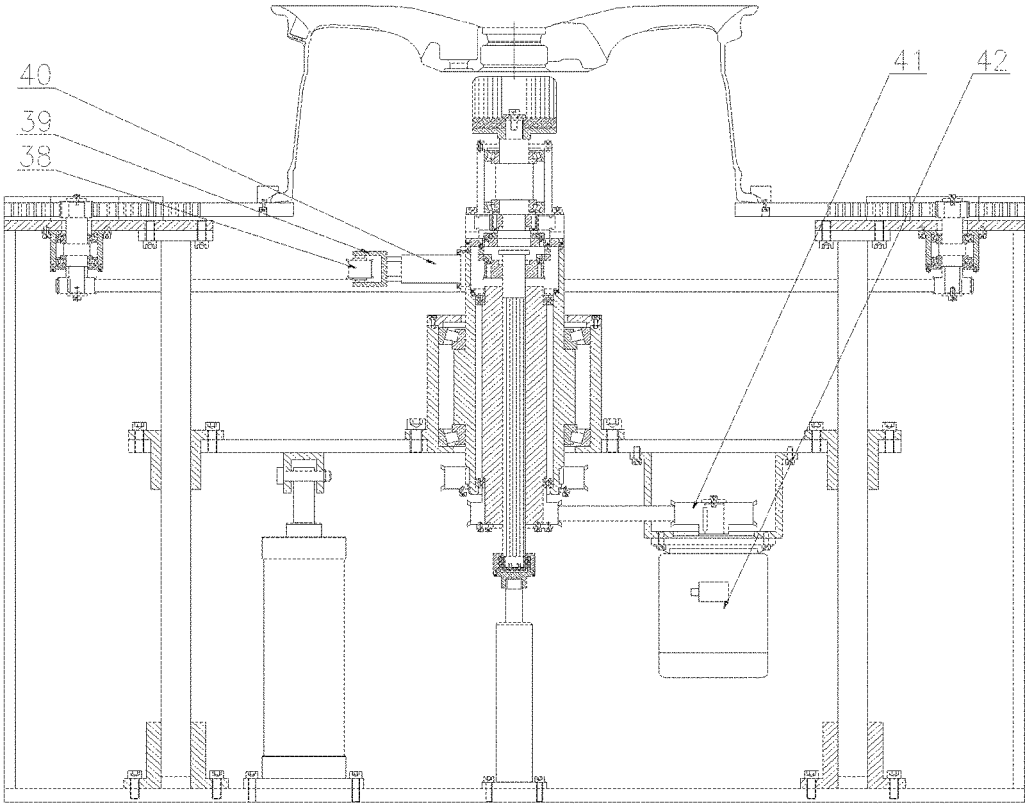
FIG. 3 is a left view of a wheel deburring device in the present invention.
Figure 4:
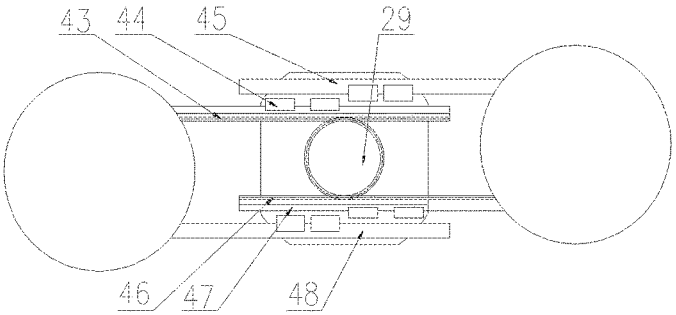
FIG. 4 is a top view of a size adjusting portion of left and right hair brushes of a wheel deburring device in the present invention.
Figure 5:
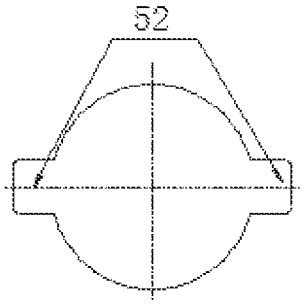
FIG. 5 is a top view of a spline shaft of a wheel deburring device in the present invention.
Figure 6:
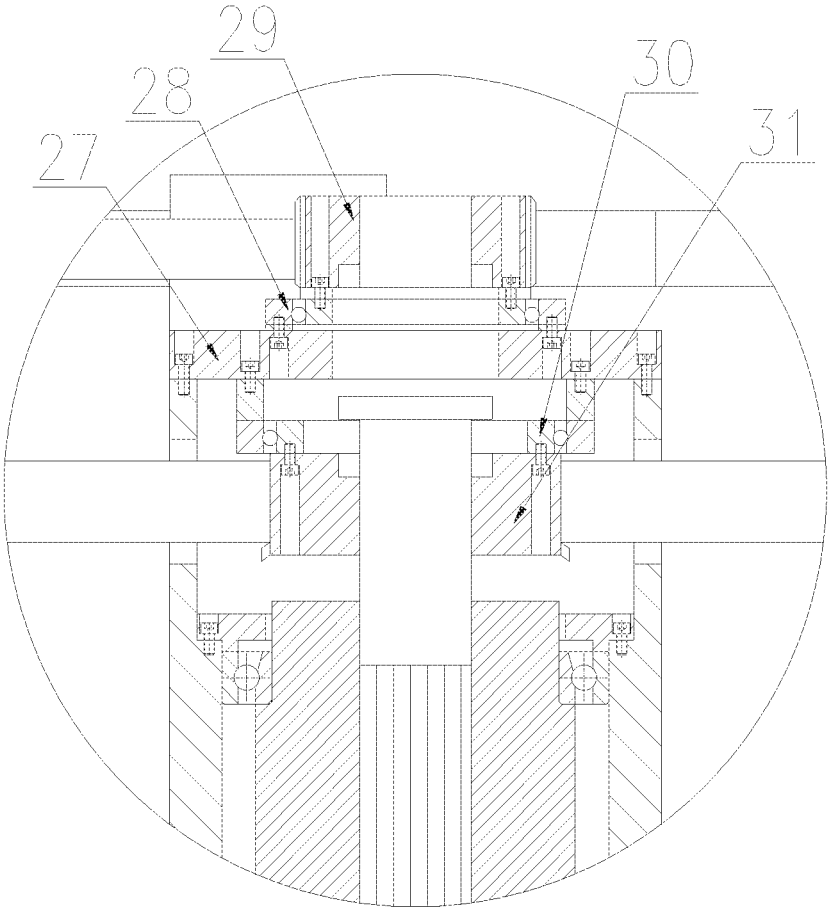
FIG. 6 is a partial front view of a burr brushing system of a wheel deburring device in the present invention.
Figure 7:
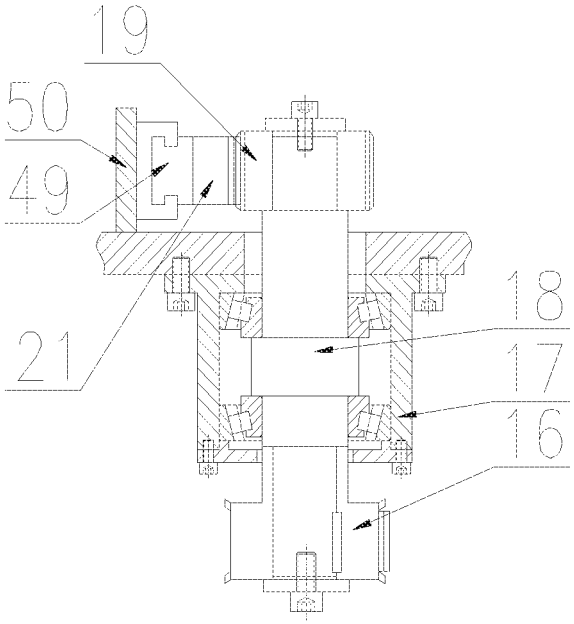
FIG. 7 is a partial front view of a clamping system of a wheel deburring device in the present invention.

In figures, 1—frame, guide posts 2, 3—cylinder I, 4—motor, 5—rotary joint, 6—lower belt pulley I, 7—lower belt pulley II, 8—lower belt pulley III, 9—sliding sleeve, 10—servo motor I, 11—lifting plate, 12—large bearing seat, 13—hollow shaft, 14—spline sleeve, 15—spline shaft, 16—upper belt pulley I, 17—bearing seat I, 18—shaft I, 19—gear I, 20—upper belt pulley II, 21—gear rack I, 22—radial block, 23—left bottom plate, 24—left shaft, 25—left bearing seat, 26—left hair brush, 27—substrate, 28—upper rotating ring, 29—gear II, 30—lower rotating ring, 31—upper belt pulley III, 32—right hair brush, 33—right shaft, 34—right bearing seat, 35—right bottom plate, 36—clamping synchronous belt, 37—cylinder II, 38—tensioning wheel, 39—framework, 40—tensioning cylinder, 41—lower belt pulley IV, 42—servo motor II, 43—left gear rack, 44—left guide rail, 45—guide rail I, 46—right gear rack, 47—right guide rail, 48—guide rail II, 49—guide rail III, 50—upright plate, 51—transmission synchronous belt, and 52—lug ring.

DETAILED DESCRIPTION OF THE PREFERRED EMBODIMENTS

Details and operations of the device provided by the invention will now be described below with reference to the attached drawings.

The device consists of a frame 1, guide posts 2, a cylinder I 3, a motor 4, a rotary joint 5, a lower belt pulley I 6, a lower belt pulley II 7, a lower belt pulley III 8, sliding sleeves 9, a servo motor I 10, a lifting plate 11, a large bearing seat 12, a hollow shaft 13, a spline sleeve 14, a spline shaft 15, upper belt pulleys I 16, bearing seats I 17, shafts I 18, gears I 19, upper belt pulleys II 20, gear racks I 21, radial blocks 22, a left bottom plate 23, a left shaft 24, a left bearing seat 25, a left hair brush 26, a substrate 27, an upper rotating ring 28, gears II 29, a lower rotating ring 30, an upper belt pulley III 31, a right hair brush 32, a right shaft 33, a right bearing seat 34, a right bottom plate 35, a clamping synchronous belt 36, a cylinder II 37, a tensioning wheel 38, a framework 39, a tensioning cylinder 40, a lower belt pulley IV 41, a servo motor II 42, a left gear rack 43, a left guide rail 44, a guide rail I 45, a right gear rack 46, a right guide rail 47, a guide rail II 48, a guide rail III 49, a upright plate 50, and a transmission synchronous belt 51. Both the cylinder II 37 and the cylinder I 3 are fixed on the bottom plate of the frame 1; the output end of the cylinder II 37 is hinged to the lower side of the lifting plate 11; four guide posts 2 are fixed between the bottom plate and a working platform of the frame 1; the rotary joint 5 is fixed between the cylinder I 3 and the spline shaft 15; four sliding sleeves 9 matched with the guide posts 2 are fixed on the lifting plate 11; the motor 4 with the lower belt pulley III 8 mounted at the output end is mounted below the lifting plate 11 by a flange; the large bearing seat 12 is fixed above the lifting plate 11; the hollow shaft 13 is fixed in the large bearing seat 12 by a bearing, the upper side of the hollow shaft 13 is connected with the substrate 27, and the lower belt pulley II 7 is fixed at the lower end of the hollow shaft 13; the spline sleeve 14 with the lower belt pulley I 6 fixed at the lower end is fixed in the hollow shaft 13 by a bearing, and the spline shaft 15 is matched with the spline sleeve 14; the upper belt pulley III 31 is fixed below the substrate 27 by the lower rotating ring 30; the gear II 29 is fixed above the substrate 27 by the upper rotating ring 28;

the left bearing seat 25 is fixed above the left bottom plate 23, and the left shaft 24 with the left hair brush 26 fixed at the upper side and the upper belt pulleys II 20 fixed at the lower side is fixed in the left bearing seat 25 by a bearing. The right bearing seat 34 is fixed above the right bottom plate 35, and also the right shaft 33 with the right hair brush 32 fixed at the upper side and the upper belt pulleys II 20 fixed at the lower side is fixed in the right bearing seat 34 by a bearing.

Both one end of the left gear rack 43 and one end of the slide rail of the guide rail II 48 are fixed below the left bottom plate 23; the left gear rack 43 is fixed on the slide rail of the left guide rail 44; both one end of the slide rail of the guide rail I 45 and one end of the right gear rack 46 are fixed below the right bottom plate 35; the right gear rack 46 is fixed on the slide rail of the right guide rail 47; both the left gear rack 43 and the right gear rack 46 are engaged with the gears II 29; the slide blocks of the left guide rail 44, guide rail I 45, right guide rail 47 and guide rail II 48 are all fixed above the substrate 27; the tensioning wheel 38 is fixed in the framework 39, the tensioning cylinder 40 is fixed at the upper end of the hollow shaft 13, and the output end of the tensioning cylinder 40 is connected with the framework 39; the servo motor II 42 with the output end mounted with the lower belt pulley IV 41 is fixed below the lifting plate 11 by a flange; the transmission synchronous belt 51 is simultaneously engaged with two upper belt pulleys II 20, the upper belt pulley III 31 and the tensioning wheel 38; and the above components form a burr brushing system of the device.

Four bearing seats I 17 are uniformly distributed and fixed on corresponding positions below the working platform of the frame 1; four shafts I 18 with the gears I 19 fixed at the upper ends and the upper belt pulleys I 16 fixed at the lower ends are fixed in the bearing seats I 17 by bearings; the servo motor 10 I is fixed on the side face of the frame 1, and the output end of the servo motor 10 I is connected with one shaft I 18 therein; the clamping synchronous belt 36 is simultaneously connected with four upper belt pulleys I 16; four radial blocks 22 are respectively fixed at each end of four gear racks I 21; one side of the gear rack I 21 is engaged with the gear I 19, the other side of the gear rack I is fixed on the slide rail of the guide rail III 49, and the slide block of the guide rail III 49 is fixed on the upright plate 50; and the above components form a clamping system of the device.

One servo motor II 42 can be used for both achieving simultaneous rotation of the left hair brush 26 and the right hair brush 32 and adjusting the distance between the left hair brush 26 and the right hair brush 32 by the mutual engagement of the left gear rack 43, the right gear rack 46 and the gear II 29 to make the distance between the left hair brush 26 and the right hair brush adapt to wheels with different sizes.

The servo motor I 10 simultaneously drives four gears I 19 to rotate by the upper belt pulleys I 16 and the clamping synchronous belt 36, and wheels with different sizes can be automatically clamped by four gear racks I 21.

In a working process, according to the size of the wheel, the servo motor I 10 drives the clamping synchronous belt 36 to simultaneously drive the four gears I 19 to rotate, and the wheel can be automatically clamped by the four gear racks I 21 and the radial blocks 22; the cylinder I 3 jacks up the spline shaft 5 to make the lug rings 52 at the top end thereof match with the gear II 29, the servo motor II 42 drives the spline shaft 15 and the gear II 29 to rotate by the lower belt pulley IV 41, and then automatically adjusts the distance between the left hair brush 26 and the right hair brush 32 by the left gear rack 43 and the right gear rack 46 according to the size of the wheel; then, the cylinder I 3 lowers the spline shaft 15 to make the lug rings 52 at the top end thereof match with the upper belt pulley III 31, and the servo motor II 42 drives the spline shaft 15, the upper belt pulley III 31, two upper belt pulleys II 20, the left hair brush 26 and the right hair brush 32 to simultaneously rotate by the lower belt pulley IV 41; meanwhile, the motor 4 drives the hollow shaft 13, the substrate 27 and the two hair brushes to simultaneously rotate around the central axis of the wheel by the lower belt pulley III 8; and the cylinder II 37 jacks up the left and right hair brushes by the guide posts 2 to make the left and right hair brushes touch the wheel back cavity, and then deburring can be carried out.

The invention claimed is:

1. A wheel deburring device, comprising: a frame, guide posts, a cylinder I, a motor, a rotary joint, a lower belt pulley I, a lower belt pulley II, a lower belt pulley III, sliding sleeves, a servo motor I, a lifting plate, a large bearing seat, a hollow shaft, a spline sleeve, a spline shaft, upper belt pulleys I, bearing seats I, shafts I, gears I, upper belt pulleys II, gear racks I, radial blocks, a left bottom plate, a left shaft, a left bearing seat, a left hair brush, a substrate, an upper rotating ring, gears II, a lower rotating ring, an upper belt pulley III, a right hair brush, a right shaft, a right bearing seat, a right bottom plate, a clamping synchronous belt, a cylinder II, a tensioning wheel, a framework, a tensioning cylinder, a lower belt pulley IV, a servo motor II, a left gear rack, a left guide rail, a guide rail I, a right gear rack, a right guide rail, a guide rail II, a guide rail III, an upright plate, and a transmission synchronous belt, wherein both of the cylinder II and the cylinder I are fixed on a bottom plate of the frame; an output end of the cylinder II is hinged to a lower side of the lifting plate; the four guide posts are fixed between the bottom plate of the frame and a working platform of the frame; the rotary joint is fixed between the cylinder I and the spline shaft; the four sliding sleeves matched with the guide posts are fixed on the lifting plate; the motor with the lower belt pulley III mounted at an output end of the motor is mounted below the lifting plate by a flange; the large bearing seat is fixed above the lifting plate; the hollow shaft is fixed in the large bearing seat by a bearing, an upper side of the hollow shaft is connected with the substrate, and the lower belt pulley II is fixed at a lower end of the hollow shaft; the spline sleeve with the lower belt pulley I fixed at a lower end of the spline sleeve is fixed in the hollow shaft by a bearing, and the spline shaft is matched with the spline sleeve; the upper belt pulley III is fixed below the substrate by the lower rotating ring; the gears II are fixed above the substrate by the upper rotating ring;

wherein the left bearing seat is fixed above the left bottom plate, and the left shaft, is fixed in the left bearing seat by a bearing, the left hair brush fixed at an upper side of the left shaft and the upper belt pulleys II fixed at a lower side of the left shaft; the right bearing seat is fixed above the right bottom plate, and the right shaft is fixed in the right bearing seat by a bearing, the right hair brush fixed at an upper side of the right shaft and the upper belt pulleys II fixed at a lower side of the right shaft;

wherein one end of the left gear rack and one end of a slide rail of the guide rail II are fixed below the left bottom plate; the left gear rack is fixed on a slide rail of the left guide rail; one end of a slide rail of the guide rail I and one end of the right gear rack are fixed below the right bottom plate; the right gear rack is fixed on a slide rail of the right guide rail; the left gear rack and the right gear rack are simultaneously engaged with the gear II; each of the left guide rail, the guide rail I, the right guide rail, and the guide rail II has a slide block fixed above the substrate; the tensioning wheel is fixed in the framework, the tensioning cylinder is fixed at an upper end of the hollow shaft, and an output end of the tensioning cylinder is connected with the framework; the servo motor II is fixed below the lifting plate by a flange, the lower belt pulley IV mounted at an output end of the servo motor II; the transmission synchronous belt is simultaneously engaged with the two upper belt pulleys II, the upper belt pulley III and the tensioning wheel; and further wherein the four bearing seats I are uniformly distributed and fixed on corresponding positions below the working platform of the frame; the four shafts I are fixed in the bearing seats I by bearings, the gears I fixed at upper ends of the four shafts I and the upper belt pulleys I fixed at lower ends of the four shafts I; the servo motor I is fixed on a side face of the frame, and an output end of the servo motor I is connected with one of the four shafts I; the clamping synchronous belt is simultaneously connected with the four upper belt pulleys I; each of the four radial blocks is fixed at one end of one of the four gear racks I; and one side of the gear rack I is engaged with the gear I, and the opposite side of the gear rack I is fixed on a slide rail of the guide rail III, and a slide block of the guide rail III is fixed on the upright plate.

2. The wheel deburring device of claim 1, wherein the left hair brush and the right hair brush simultaneously rotate, and the distance between the left hair brush and the right hair brush is adjusted by the engagement of the left gear rack, the right gear rack and the gear II.

3. The wheel deburring device of claim 1, wherein the servo motor I simultaneously drives the four gears I to rotate by the upper belt pulleys I and the clamping synchronous belt so that, wheels with different sizes are clamped by the four gear racks I.

* * * * *